US010424855B2

(12) United States Patent
Smith et al.

(10) Patent No.: US 10,424,855 B2
(45) Date of Patent: Sep. 24, 2019

(54) CONNECTOR TERMINALS WITH IMPROVED SOLDER JOINT

(71) Applicant: AIRBORN, INC., Georgetown, TX (US)

(72) Inventors: Jason Smith, Sartell, MN (US); Emad Soubh, Camas, WA (US)

(73) Assignee: AIRBORN, INC., Georgetown, TX (US)

( * ) Notice: Subject to any disclaimer, the term of this patent is extended or adjusted under 35 U.S.C. 154(b) by 260 days.

(21) Appl. No.: 15/262,920

(22) Filed: Sep. 12, 2016

(65) Prior Publication Data

US 2018/0076545 A1 Mar. 15, 2018

(51) Int. Cl.

| | |
|---|---|
| ***H01R 43/20*** | (2006.01) |
| ***H01R 12/57*** | (2011.01) |
| ***H01R 4/02*** | (2006.01) |

(52) U.S. Cl.

CPC ..... *H01R 12/57* (2013.01); *H01R 4/028* (2013.01); *Y10T 29/53209* (2015.01)

(58) Field of Classification Search

CPC .. H01R 12/716; H01R 43/0256; H01R 4/028; H01R 12/58; H05K 3/3426; H05K 7/14; Y10T 29/53209

USPC ..... 29/747, 33 M, 843, 874, 876, 729, 739, 29/787

See application file for complete search history.

(56) References Cited

U.S. PATENT DOCUMENTS

| | | | | |
|---|---|---|---|---|
| 3,989,331 | A | 11/1976 | Hanlon | |
| 5,788,539 | A | 8/1998 | Fedder | |
| 6,692,265 | B2 * | 2/2004 | Kung | H01R 12/57 439/68 |
| 6,969,286 | B1 | 11/2005 | Mongold et al. | |
| 6,979,238 | B1 | 12/2005 | Mongold et al. | |
| 7,052,337 | B2 | 5/2006 | Mongold et al. | |
| 7,125,393 | B2 | 10/2006 | Mongold et al. | |
| 7,159,312 | B2 | 1/2007 | Mongold et al. | |
| 7,172,438 | B2 | 2/2007 | Vicich et al. | |
| 7,178,232 | B2 | 2/2007 | Mongold et al. | |
| 7,377,795 | B2 | 5/2008 | Vicich et al. | |
| 7,931,477 | B2 | 4/2011 | Hirata et al. | |
| 8,337,218 | B2 | 12/2012 | Hirata et al. | |
| 8,894,423 | B2 | 11/2014 | Mongold et al. | |
| 8,911,258 | B2 * | 12/2014 | Soubh | H01R 12/724 439/638 |

* cited by examiner

*Primary Examiner* — Thiem D Phan
(74) *Attorney, Agent, or Firm* — Locke Lord LLP

(57) ABSTRACT

A connector lead has a lead terminal that includes a recessed solder wicking restriction area for ensuring that enough solder remains on or near the lead terminal. The lead terminal has a neck portion and a base portion extending from the neck portion. The neck portion has a width that is narrower than the width of the lead. The narrower neck portion defines a recessed solder wicking restriction area that encourages more solder to accumulate on or near the base portion instead of wicking up the lead. The width of the neck portion may also be narrower than the width of the base portion, causing the lead terminal to resemble an inverted "T" when viewed from the front. A band of solder resistive material may be applied circumferentially or laterally around the connector lead above the lead terminal to limit wicking in some embodiments.

10 Claims, 6 Drawing Sheets

CONNECTOR TERMINALS WITH IMPROVED SOLDER JOINT

BACKGROUND OF THE INVENTION

Field of Invention

The disclosed embodiments are directed to a surface mounted board-mount connector having lead terminals that facilitate formation of a good solder joint between the lead terminal and a solder pad on a given substrate and method therefor. More specifically, the disclosed embodiments are directed to an apparatus and method for retaining a sufficient amount of solder on the lead terminals of such a board-mount connector to form a good solder joint.

Description of Related Art

A board-mount connector is a type of electrical connector that is mounted on a printed circuit board (PCB) or other substrate. A cable having an appropriate intermating connector may then be inserted in the board-mount connector to mechanically and electrically connect the cable to components on the PCB. The board-mount connector typically has a plurality of leads and each lead typically terminates at a foot or other lead terminal. Surface mount soldering is then used to physically attach and electrically connect the lead terminals to the PCB.

For board-mount connectors, surface mount soldering typically entails screen-printing a thin, fixed-volume layer of solder on a plurality of solder pads on the PCB, then placing the connector on the PCB so that the lead terminals rest on the solder-covered pads. A sufficient amount of heat is then applied to melt the solder, after which the molten solder begins wicking up the connector lead terminals during the wetting process. The heat is then removed and the solder is allowed to solidify to form a fillet that provides a connection between each lead terminal and one of the solder pads of the PCB. Good solder joints will have smooth, concave fillets around the lead terminals. These solder fillets mechanically bond and electrically connect the connector lead terminals to the solder pads on the PCB. It is therefore important that each solder joint contain a sufficient amount of solder to form an acceptable shaped solder fillet, strong mechanical bond, and highly conductive electrical connection.

A problem may arise if the heat is not removed quickly enough from the solder, allowing the molten solder to continue wicking up the length of the connector lead beyond the top of the desired solder fillet. Because there is a fixed volume of solder on the pad, when this happens, too much of the solder may be wicked up the terminal into the area above the desired fillet area, leaving too little solder in the desired fillet area to form a good, strong solder joint. The shortage of solder in the fillet area may result in a solder joint that is not mechanically strong enough to withstand the forces that it is subjected to during use, such as mating and unmating of the connectors, differential thermal expansion between the PCB and the connector, vibration of the PCB, and so forth.

Accordingly, a need exists in the electrical connector art for a way to ensure enough solder remains on or near the connector lead terminals to form a good solder joint.

SUMMARY OF DISCLOSED EMBODIMENTS

The embodiments disclosed herein are directed to an apparatus and method for ensuring that enough solder remains on or near a connector lead terminal to form a good solder joint. The apparatus and method also provide a way to minimize or limit how far the solder may wick up the length of a connector lead. In some embodiments, the apparatus and method involve providing a lead terminal having a base portion and a neck portion extending from the base portion. The base portion is wider than the width of the lead while the neck portion is narrower than the width of the lead, causing the lead terminal to somewhat resemble an inverted "T." The narrower neck portion defines a recessed solder wicking restriction area that encourages more solder to accumulate on or near the base portion instead of wicking up the connector lead. This causes more of the solder to remain on or near the lead terminal, which helps make a better and stronger solder joint. To the extent wicking may occur, a band of solder resistive material may be applied circumferentially or laterally around the connector lead above the lead terminal to limit the wicking in some embodiments. The solder resistive band may be a solder mask, a non-wettable ink (e.g., printer ink), or other material that repels solder wetting. Such a solder resistive band creates a solder barrier or dam that prevents the solder from wicking too far up the length of the connector lead. The foregoing features help retain more of the solder on or near the lead terminal, resulting in a better solder joint between the lead terminal and the solder pad.

In general, in one aspect, embodiments of the invention relate to a board-mount connector. The board-mount connector comprising, among other things, a housing, a plurality of electrical contacts disposed within the housing, and a plurality of leads extending from the housing, each lead having a main lead body electrically connected to one of the electrical contacts. A lead terminal extends from an end of the main lead body, the lead terminal including a neck portion and a base portion extending from the neck portion, the neck portion being narrower than the main lead body and the base portion. The neck portion defines a solder wicking restriction area into which solder may flow between the main lead body and the base portion, the solder wicking restriction area decreasing an amount of solder wicking up the main lead body.

In general, in another aspect, embodiments of the invention relate to a method of forming an electrical and mechanical connection between the lead terminal of the board-mount connector and a substrate. The method comprises, among other things, placing the lead terminal on a deposit of solder on the substrate and flowing the solder over the lead terminal, wherein the solder wicking restriction area decreases an amount of solder wicking up the connector lead.

In general, in yet another aspect, embodiments of the invention relate to a lead frame. The lead frame comprises, among other things, a plurality of electrical contacts disposed in the lead frame and a plurality of leads disposed in the lead frame, each lead having a main lead body electrically connected to one of the electrical contacts. A lead terminal extends from an end of the main lead body, the lead terminal including a neck portion and a base portion extending from the neck portion, the neck portion being narrower than the main lead body and the base portion. The neck portion defines a solder wicking restriction area into which solder may flow between the main lead body and the base portion, the solder wicking restriction area decreasing an amount of solder wicking up the main lead body.

In general, in still another aspect, embodiments of the invention relate to a connector lead. The connector lead comprises, among other things, a main lead body and a lead terminal extending from an end of the main lead body. The lead terminal includes a neck portion and a base portion extending from the neck portion. The neck portion is narrower than the main lead body and the base portion so as to define a solder wicking restriction area into which solder may flow between the main lead body and the base portion during soldering. The solder wicking restriction area decreases an amount of solder wicking up the main lead body.

Additional and/or alternative aspects of the invention will become apparent to those having ordinary skill in the art from the accompanying drawings and following detailed description of the disclosed embodiments.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

The figures described above and the written description of specific structures and functions below are not presented to limit the scope of what Applicants have invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with apparatus-related, business-related, government-related and other constraints, which may vary by specific implementation, location, and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

Figure 1:
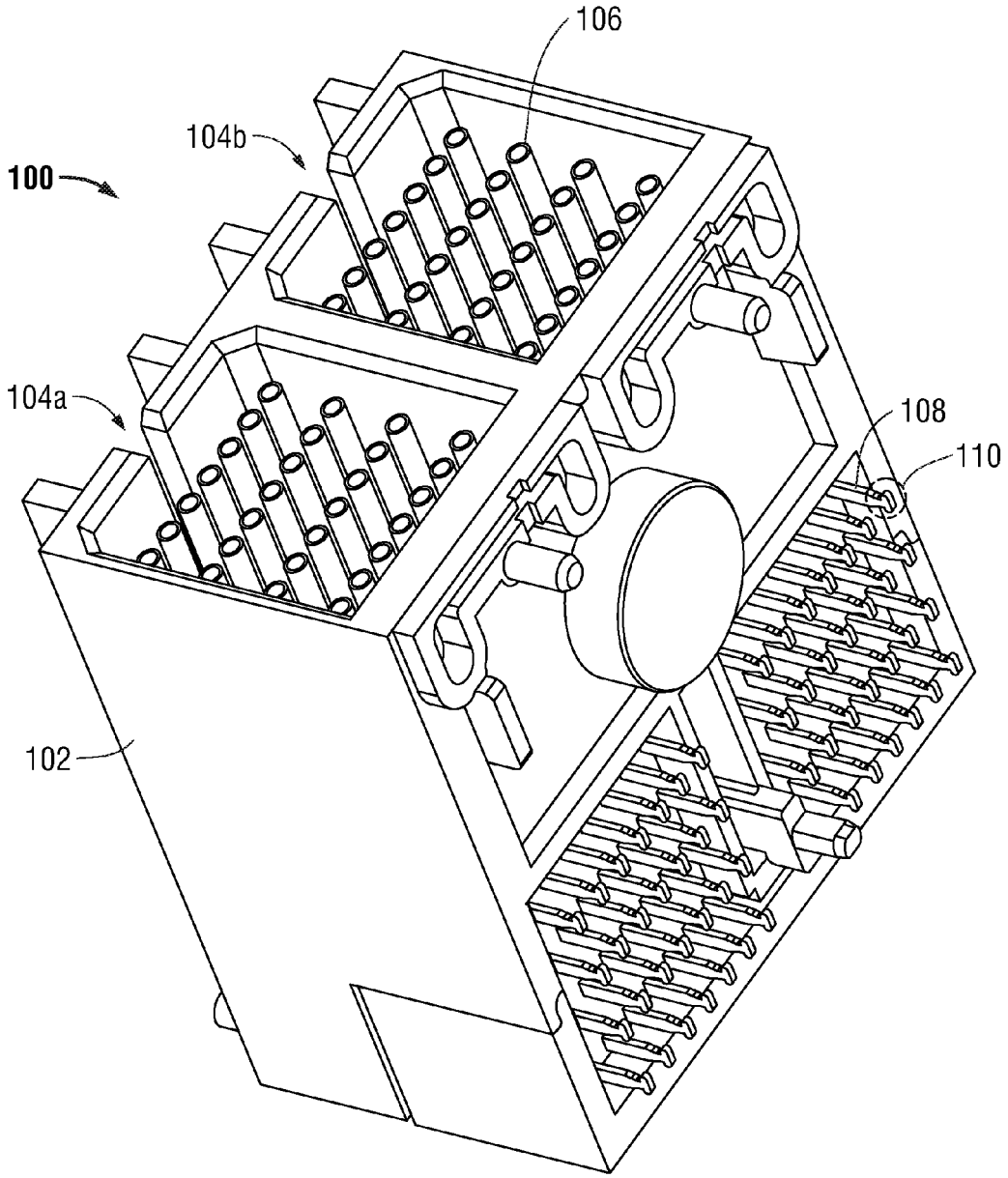
FIG. 1 is a bottom perspective view of an exemplary electrical connector assembly having lead terminals according to the disclosed embodiments.

Referring first to FIG. 1, an exemplary board-mount connector 100 is shown having connector lead terminals designed for greater solder retention according the embodiments disclosed herein. The board-mount connector 100 seen here is a low-profile right-angle connector that allows a cable connector to be inserted at a 90 degree angle relative to a PCB or other substrate (not expressly shown). Examples of PCBs to which the board mount connector 100 may be inserted include Peripheral Component Interconnect Express ("PCIe") cards. Those having ordinary skill in the art will understand of course that the low-profile right-angle connector is exemplary only and that the teachings and principles discussed herein may be applied to other types of board-mount connectors without departing from the scope of the disclosed embodiments.

In the example of FIG. 1, the board-mount connector 100 has a housing 102 that defines dual bays, a first bay 104*a* and a second bay 104*b*. Each bay 104*a*, 104*b* includes a plurality of electrical contacts, one of which is indicated at 106, for receiving a separate cable connector (not expressly shown). The electrical contacts 106 in each bay 104*a*, 104*b* are typically made of copper or a copper alloy or other suitable material and arranged in seven rows of four electrical contacts per row for a total of 56 electrical contacts 106. These electrical contacts 106 may be either pin contacts for a male connector or socket contacts for a female connector (illustrated here), depending on the particular application. Each electrical contact 106 has a corresponding lead, one of which is indicated at 108, disposed at a right angle to a mating axis of the electrical contact 106. The leads 108 are likewise arranged in seven rows of four leads per row for a total of 56 leads. Each lead 108 terminates at a lead terminal, one of which is indicated at 110, that allows the board-mount connector 100 to be soldered to the PCIe card or other substrate.

Figure 2:
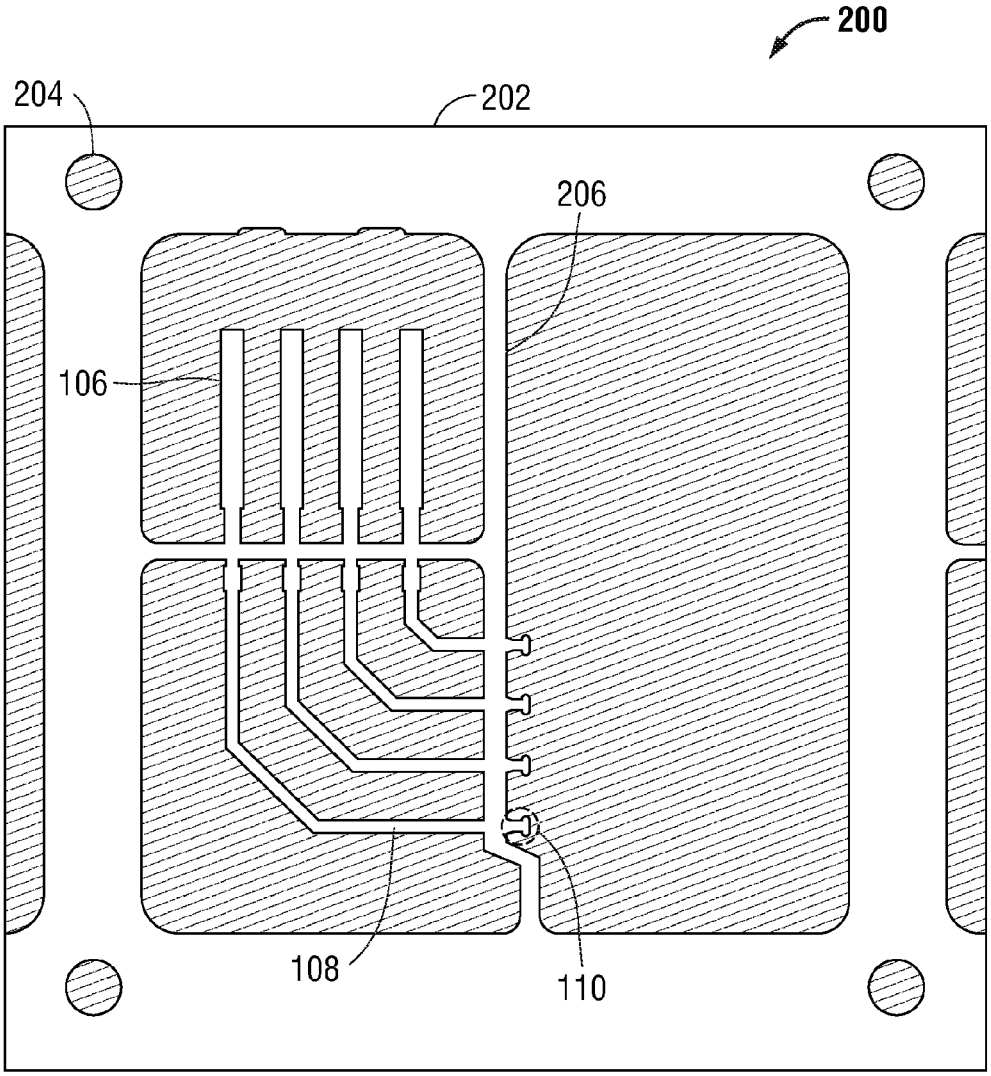
FIG. 2 is a plan view of an exemplary lead frame showing lead terminals according to the disclosed embodiments.

Referring next to FIG. 2, the various electrical contacts 106, leads 108, and lead terminals 110 of the board-mount connector 100 are typically provided in the form of a lead frame. Lead frames are typically produced in a long strip 200 containing dozens or hundreds of lead frames, one of which is indicated 202. The lead frames 202 are manufactured by removing material from a flat sheet or strip of copper or copper alloy, either by etching or stamping or some other suitable process. Each lead frame 202 usually has one or more alignment holes, one of which is indicated 204, that allow the lead frames 202 to be quickly and precisely moved through automated assembly equipment.

In the example shown here, each lead frame 202 has a set of four electrical contacts 106 connected at a right angle to four corresponding leads 108 and lead terminals 110. The electrical contacts 106, leads 108, and lead terminals 110 are secured in place within the lead frame 202 via interconnecting support struts, one of which is indicated at 206, that are removed (e.g., excised) during the assembly process. The lead frames 202 get "insert-molded" (molded into a block of plastic) to form a "wafer," then seven of these wafers are disposed in each bay 104*a*, 104*b* to form the dual-bay board-mount connector 100. Those having ordinary skill in the art will of course understand that there may be a different number of electrical contacts 106, leads 108, and lead terminals 110 in each lead frame 202, and/or a different number of lead frames 202 in each bay 104*a*, 104*b*, and/or a different number of bays 104*a*, 104*b*, in each board-mount connector 100, without departing from the scope of the disclosed embodiments.

In accordance with the disclosed embodiments, each lead terminal 110 is provided with one or more features designed to ensure greater solder retention on the lead terminal 110 near a base portion thereof during the soldering process. The greater solder retention allows a better solder joint, one that is substantially free of defects, to be formed on the lead terminals 110 during the soldering process. Following is a more detailed description of these solder retention features.

Figure 3A:
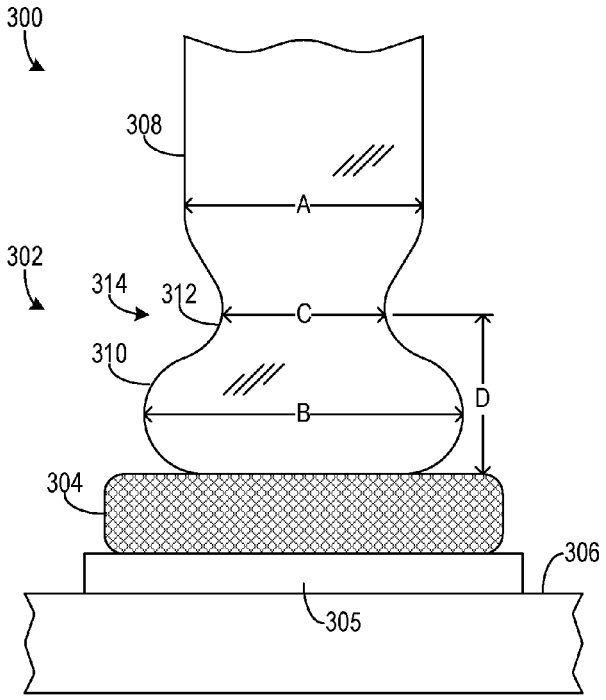
FIGS. 3A and 3B are front and side views, respectively, of an exemplary connector lead terminal according to the disclosed embodiments.
Figure 3B:
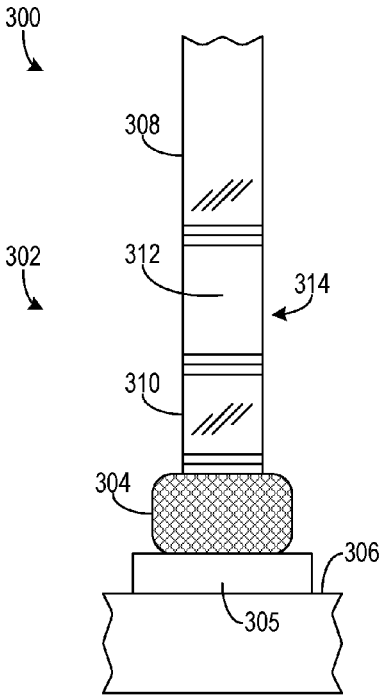

Referring now to FIGS. 3A and 3B, a front view and side view, respectively, of an exemplary lead 300 for a board-mount connector is shown having a lead terminal 302 in accordance with the disclosed embodiments. As can be seen, the lead terminal 302 rests on a screen printed deposit 304 of solder (crosshatching) that has been stenciled onto a solder pad 305 of a substrate 306, such as a PCB, in preparation for soldering the lead terminal 302 to the substrate 306. The solder pad 305 is typically made of copper or a copper alloy, but other suitable materials may certainly be used. In this example, the lead 300 is a flat or planar lead, as evidenced by the side view of FIG. 3B. However, those having ordinary skill in the art will understand that circular leads and other lead shapes may also be implemented without departing from the scope of the disclosed embodiments.

The lead 300 includes a main lead body 308 having a width "A" running along a vertical length of the lead, and the lead terminal 302 includes a foot or base portion 310 having a width "B" that is larger at its widest point than the width "A" of the main lead body 308. A neck portion 312 extends from the base portion 310 to the main lead body 308. The neck portion 312 has a width "C" that is narrower at its narrowest point than both the width "A" of the main lead body 308 and the width "B" of the base portion 310. The narrower neck portion 312 together with the wider base portion 310 gives the lead terminal 302 an upside down or inverted "T" shape when viewed from the front (see FIG. 3A). More importantly, the narrower neck portion 312 together with the wider base portion 310 and main lead body 308 define a sort of recessed solder wicking restriction area 314 that resembles a cavity on both sides of the lead terminal 302.

A number of benefits may be derived from the narrow neck portion 312 and the recessed solder wicking restriction area 314. For one thing, solder wicking is inhibited by the narrower neck portion 312, which acts as a kind of bottleneck to discourage solder from wicking up onto the wider lead body 308 (width "A"). As well, the recessed solder wicking restriction area 314 provides more room for solder to accumulate, leaving less of the solder available for wicking up the lead body 308. The solder also covers extra surface area over the base portion 310, which helps anchor or otherwise hold the base portion 310 to the solder pad 305. The degree to which any of these benefits may accrue depends, at least in part, on the distance "D" from the narrowest part of the neck portion 312 to the bottom of the base portion 310, which distance may be selected as needed for the size of the recessed solder wicking restriction area 314 and hence the wicking-inhibiting effect desired. The confinement of the solder to the base portion 310 and the neck portion 312 results in more of the solder remaining on the solder pad 305 and the base portion 310, thereby creating a better solder fillet shape and hence a stronger solder joint.

The term "inhibit" as used herein generally means reducing the amount of wicking that would otherwise occur, including but not limited to: from a partial decrease (e.g. about 25% reduction); up to a substantial decrease (e.g., about 50% reduction); and up to and including completely preventing (i.e., 100% reduction) molten solder from wicking past the recessed solder wicking restriction area 314.

In the example of FIGS. 3A and 3B, the main lead body 308, base portion 310, and neck portion 312 may be contiguous with one another (i.e., stamped from a single piece). In addition, the main lead body 308, base portion 310, and neck portion 312 may be centered relative to each other so that the left half of the lead 300 appears symmetrical to the right half when viewed from the front (see FIG. 3A). As well, the main lead body 308, base portion 310, and neck portion 312 preferably has curved or rounded corners when viewed from the front (see FIG. 3A), as sharp corners may create stress concentration points that may weaken or compromise the integrity of the solder joint. However, as those having ordinary skill in the art understand, neither a symmetrical appearance nor rounded corners are required to practice the disclosed embodiments. Nor is the width of the base portion required to be wider than the width of the main lead body to practice the disclosed embodiments (i.e., the base portion may have the same width as the lead, and may even be narrower than the lead, but should be wider than the neck portion). And the recessed solder wicking restriction area 314 may be formed on only one side of the lead terminal 302 instead of both sides in some embodiments.

In general, the dimensions for A, B, C, and D may be selected as needed for a particular application using the guidelines provided above. In some embodiments, for example, the dimensions for A, B, and C may be about 0.015 inches, 0.020 inches, and 0.010 inches, respectively, while the dimension for D may be about 0.012 inches. It should be noted that no specific dimensions are critical to the practice of the disclosed embodiments, so long as the overall effect is to cause more solder to remain on or near the solder foot 310, thereby producing a better solder joint between the lead terminal 302 and the solder pad 305 on the substrate 306. Thus, in some embodiments, rather than specific numerical values, the dimensions for A, B, C, and/or D may be selected according to certain ratios. For example, the dimensions for A and B may have a ratio of about 3:4 in some embodiments, and the dimensions for B and C may have a ratio of about 2:1 in some embodiments.

Figure 4:
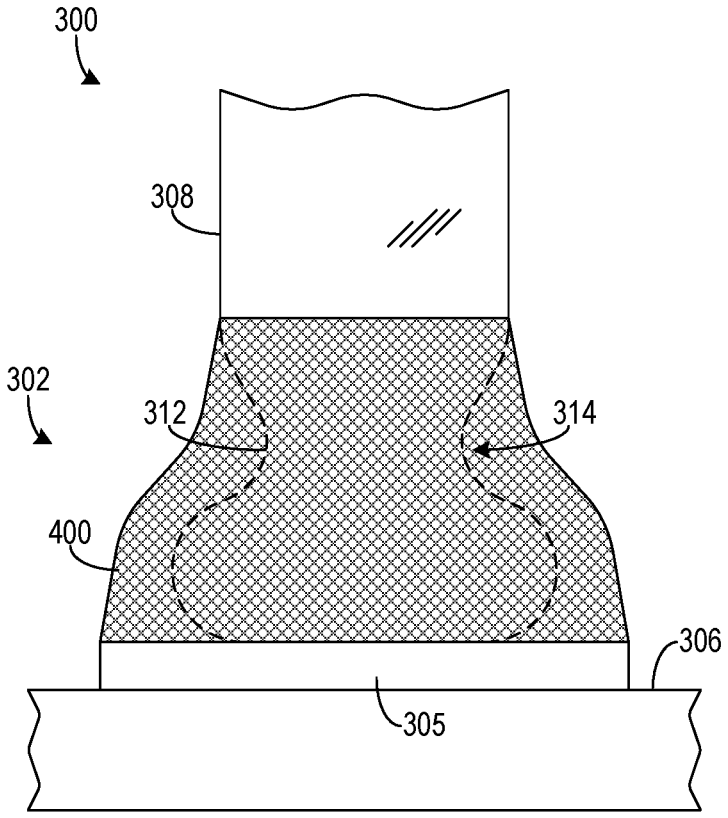
FIG. 4 is a front view of an exemplary solder joint for the exemplary connector lead terminal according to the disclosed embodiments.

FIG. 4 shows an exemplary solder fillet or joint 400 resulting from the embodiments disclosed herein. In the figure, the screen printed deposit 304 of solder (crosshatching) was sufficiently heated to cause it to flow over and around the lead terminal 302, after which the heat was removed. As it flowed, the molten solder filled in the solder wicking restriction areas 314 on each side of the lead terminal 302 created by the narrow neck portion 312 before any wicking occurred up the main lead body 308. The accumulation of solder in the solder wicking restriction areas 314 helped ensure a sufficient amount of solder remained on or near the lead terminal 302 and left less solder for wicking up the main lead body 308. The result is a good solder joint 400 that provides strong mechanical bond and highly conductive electrical connection between the lead terminal 302 and the solder pad 305 on the substrate 306.

Figure 5A:
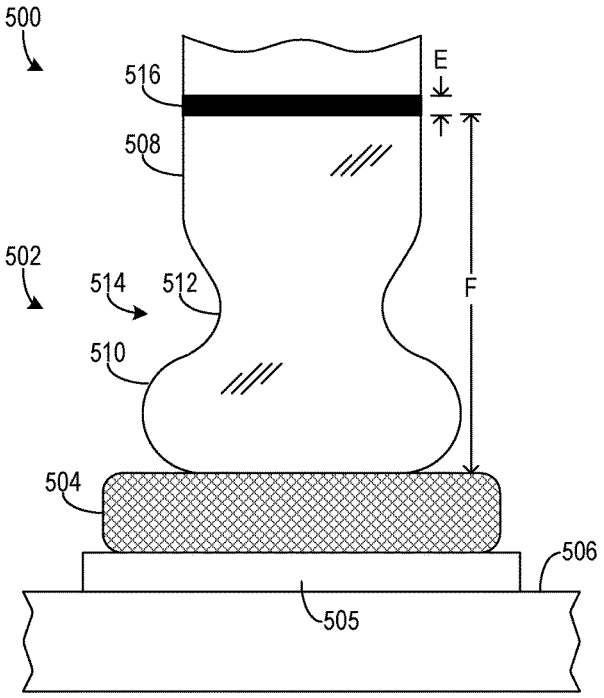
FIGS. 5A and 5B are front and side views, respectively, of an exemplary connector lead terminal having a solder barrier according to the disclosed embodiments.
Figure 5B:
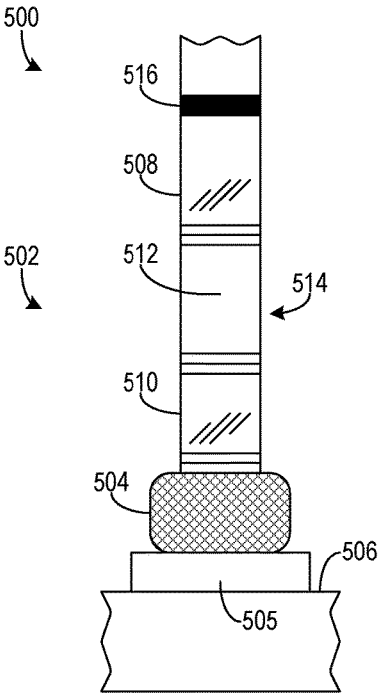

FIGS. 5A and 5B illustrate front and side views, respectively, of an exemplary lead 500 for a board-mount connector in which an optional band of solder resistive material may be provided to help limit how far up the main lead body 308 wicking may occur. As can be seen, the lead 500 in this example is similar to the lead 300 of FIGS. 3A and 3B, insofar as it has a lead terminal 502 that sits on a deposit 504

(crosshatching) of solder above a substrate 506. An optional band 516 of solder resistive material may then be applied laterally or circumferentially, either partially or completely, around the main lead body 508 above the recessed solder wicking restriction area 512 that prevents solder from wicking beyond that point on the main lead body 508. The optional solder resistive band 516 may have a thickness "E" and may be located at a distance "F" above the bottom of the base portion 510 of the lead terminal 502. The dimensions for E and F may be selected as needed depending on the requirements of the particular implementation and may include specific numerical values or a ratio thereof. Examples of suitable material for the solder resistive band 516 may include solder mask, a non-wettable ink (e.g., printer ink), or any other material that resists wetting by solder.

Figure 6A:
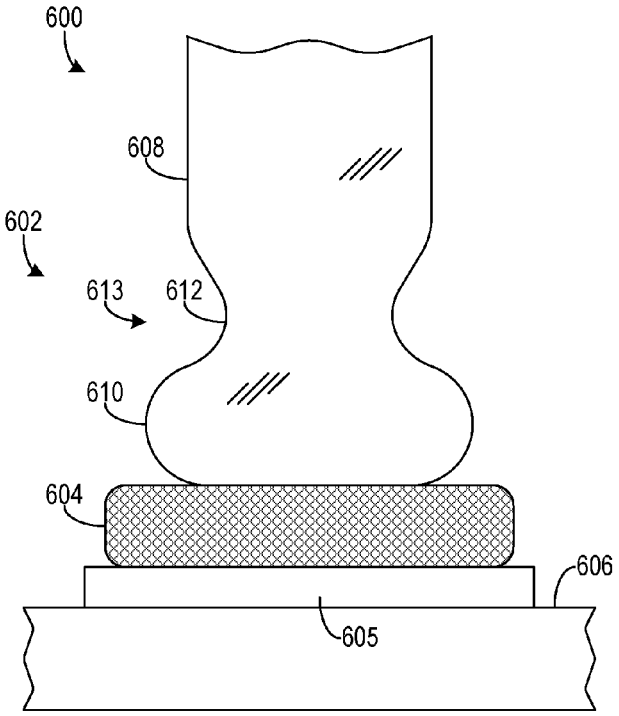
FIGS. 6A and 6B are front and top views, respectively, of an alternative connector lead terminal according to the disclosed embodiments.
Figure 6B:
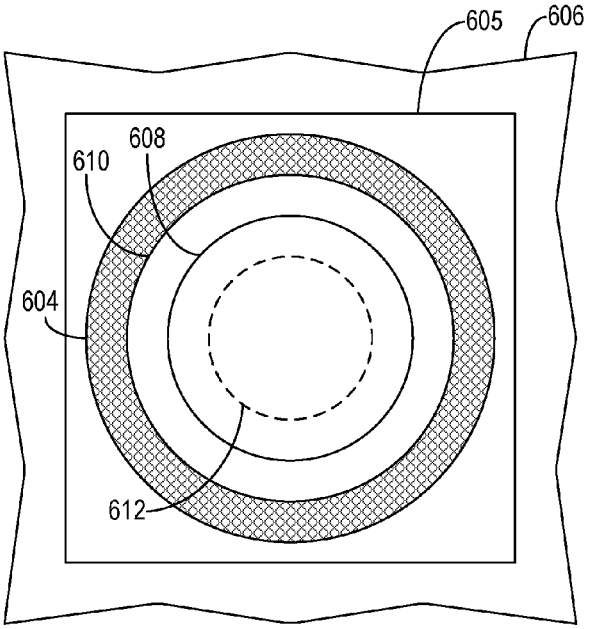

FIGS. 6A and 6B show front view and top view, respectively, of another exemplary lead 600 for a board-mount connector. The lead 600 in this example is also similar to the lead 300 of FIGS. 3A and 3B, insofar as the lead 600 has a lead terminal 602 that sits on a deposit 604 of solder above a substrate 606. However, unlike the lead 300 of FIGS. 3A and 3B, which was planar, the lead 600 shown here is a circular lead, as can be readily seen from the top view of FIG. 6B. These leads 300 and 600 otherwise have similar solder retaining features insofar as the lead terminal 602 of the lead 600 extends from and is contiguous with a main lead body 608 and is composed of a base portion 610 and a neck portion 612. The base portion 610 has a width that is larger at its widest point than the width of the main lead body 608 and the neck portion 612 has a width that is narrower at its narrowest point than both the width of the main lead body 608 and the width of the base portion 610. The narrower neck portion 612 together with the wider base portion 610 gives the lead terminal 602 an upside down or inverted "T" shape when viewed from the front (see FIG. 6A). Additionally, the narrower neck portion 612 together with the wider base portion 610 and main lead body 608 define a circular recessed solder wicking restriction area 613 around the lead terminal 602. The solder wicking restriction areas 613 help retain more solder on or near the lead terminal 602, resulting in a better solder joint between the lead terminal 602 and the substrate 606.

While a number of examples have been described in the context of preferred and other embodiments, not every embodiment of the invention has been described. For example, in addition to a circular lead, an elliptical lead, a square lead, and a rectangular lead having the above features may also be devised. Obvious modifications and alterations to the described embodiments are available to those of ordinary skill in the art. The disclosed and undisclosed embodiments are not intended to limit or restrict the scope or applicability of the invention conceived of by Applicants, but rather, in conformity with the patent laws, Applicants intend to protect fully all such modifications and improvements.

We claim:

1. A lead frame, comprising:

a plurality of electrical contacts disposed in the lead frame;

a plurality of leads disposed in the lead frame, each lead having a main lead body electrically connected to one of the electrical contacts; and a lead terminal extending from an end of the main lead body, the lead terminal including a neck portion and a base portion extending from the neck portion, the neck portion being narrower than the main lead body and the base portion;

wherein the neck portion defines a solder wicking restriction area into which solder may flow between the main lead body and the base portion, the neck portion configured to facilitate solder flow into the solder wicking restriction area such that solder covers the neck portion when a sufficient amount of solder flows into the solder wicking restriction area, the solder wicking restriction area inhibiting solder from wicking up the main lead body.

2. The lead frame according to claim 1, wherein the neck portion defines multiple solder wicking restriction areas between the lead and the base portion.

3. The lead frame according to claim 1, wherein the base portion is wider than the lead.

4. The lead frame according to claim 1, further comprising a solder resistive band disposed around the lead a predefined distance from the lead terminal.

5. The lead frame according to claim 4, wherein the solder resistive band is one of: a solder mask, and a non-wettable ink.

6. A connector lead, comprising:

a main lead body; and a lead terminal extending from an end of the main lead body, the lead terminal including a neck portion and a base portion extending from the neck portion, the neck portion being narrower than the main lead body and the base portion;

wherein the neck portion defines a solder wicking restriction area into which solder may flow between the main lead body and the base portion during soldering, the neck portion configured to facilitate solder flow into the solder wicking restriction area such that solder covers the neck portion when a sufficient amount of solder flows into the solder wicking restriction area, the solder wicking restriction area decreasing an amount of solder wicking up the main lead body.

7. The connector lead according to claim 6, wherein the neck portion defines multiple solder wicking restriction areas between the main lead body and the base portion.

8. The connector lead according to claim 6, wherein the base portion is wider than the main lead body.

9. The connector lead according to claim 6, further comprising a solder resistive band disposed around the main lead body above the solder wicking restriction area a predefined distance from the lead terminal.

10. The connector lead according to claim 9, wherein the solder resistive band is one of: a solder mask, or a non-wettable ink.

* * * * *